United States Patent [19]

Mapes

[11] Patent Number: 4,757,971

[45] Date of Patent: Jul. 19, 1988

[54] AUTOMATIC ENGINE LIFT FOR OUTBOARD MOTORS

[75] Inventor: Charles W. Mapes, Oshkosh, Wis.

[73] Assignee: Brunswick Corporation, Skokie, Ill.

[21] Appl. No.: 92,168

[22] Filed: Sep. 2, 1987

[51] Int. Cl.[4] ..... B63H 5/12

[52] U.S. Cl. ..... 248/642; 248/550; 440/1; 440/61

[58] Field of Search ..... 248/640–643, 248/550; 440/1, 61

[56] References Cited

U.S. PATENT DOCUMENTS

| | | | |
|---|---|---|---|
| 3,641,965 | 2/1972 | Schmiedel | 440/61 X |
| 3,894,250 | 7/1975 | Hager et al. | 440/1 X |
| 4,013,249 | 3/1977 | Meyer et al. | 248/642 |
| 4,318,699 | 3/1982 | Wenstadt et al. | 440/61 X |
| 4,697,535 | 10/1987 | Wileman, III | 440/1 X |

FOREIGN PATENT DOCUMENTS

| | | | |
|---|---|---|---|
| 0152697 | 9/1983 | Japan | 440/1 |

*Primary Examiner*—Alvin Chin-Shue

*Attorney, Agent, or Firm*—Andrus, Sceales, Starke & Sawall

[57] ABSTRACT

A mounting assembly for an outboard motor includes a motor mount having a transom mounting bracket attachable to a boat transom and a motor supporting bracket spaced aft of and pivotally connected by upper and lower links with the transom mounting bracket to support an outboard motor wholly aft of the boat transom, a cylinder for moving the motor supporting bracket relative to the transom mounting bracket to move the outboard motor between raised and lowered positions, a water sensor for sensing an undesirable seawater level relative to the outboard motor and for generating a signal indicative of the undesirable water level, and an actuator responsive to the undesirable water level signal for actuating the cylinder to raise the outboard motor. An engine speed sensor may also be employed to prevent actuation of the cylinder when the engine speed is above a predetermined speed.

7 Claims, 1 Drawing Sheet

AUTOMATIC ENGINE LIFT FOR OUTBOARD MOTORS

BACKGROUND OF THE INVENTION

The present invention relates to marine propulsion devices, and more particularly to a transom extension mounting assembly for an outboard motor.

Marine propulsion devices such as outboard motors are supported from a boat transom by a motor mounting assembly. Various types of motor mounting assemblies are known, as for example a transom bracket for mounting the outboard motor directly on a boat transom. While the motor may be trimmed when mounted on a transom bracket, the motor's vertical height cannot be changed. Therefore, the outboard motor is typically mounted in a compromising position at a fixed height which will provide the best possible performance. Another type of motor mounting assembly relates to one which is capable of selectively supporting an outboard motor in either raised or lowered positions wholly aft of the boat transom. Many of these latter transom extension types of mounting assemblies are of the general type which include a parallelogram linkage.

Recently, transom extension mounting assemblies have become increasingly popular on high performance outboard motor powered boats including bass boats where a lower position of the motor improves initial boat acceleration, and a higher position enhances top speed by reducing gear case drag. Additionally, a higher motor position reduces draft enhancing shallow water operation. It is further known that relocating the motor aft of the transom improves the handling characteristics of most boats at high speeds. These devices also allow the boat to have a higher transom for improved safety in following-wave conditions and they allow boat builders to manufacture a common hull/transom design for both outboard and stern drive applications.

Examples of outboard motor mounting assemblies which support the outboard motor wholly aft of the boat transom are disclosed in the following U.S. patents:

| U.S. Pat. No. | Inventor | Issue Date |
|---|---|---|
| 2,737,920 | Heath | 1956 |
| 2,782,744 | Staley | 1957 |
| 3,990,660 | Pipoz | 1976 |
| 4,013,249 | Meyer et al | 1977 |
| 4,168,818 | Ellis | 1979 |
| 4,306,703 | Finze | 1981 |
| 4,354,848 | Hall et al | 1982 |
| 4,363,629 | Hall et al | 1982 |
| 4,367,860 | Strang | 1983 |
| 4,384,856 | Hall et al | 1983 |
| 4,406,632 | Blanchard | 1983 |
| 4,406,634 | Blanchard | 1983 |
| 4,482,332 | Emmons | 1984 |
| 4,504,237 | Blanchard | 1985 |

One disadvantage of a transom extension mounting assembly is that because the outboard motor is located wholly aft of the boat transom the outboard motor's powerhead may become submerged either partially or totally while launching the boat at a boat ramp before the boat floats off its trailer or in followingwave conditions after a boat slows down too fast.

SUMMARY OF THE INVENTION

A mounting assembly for a marine propulsion device comprises a motor mounting means for supporting a marine propulsion device wholly aft of a boat transom, said motor mounting means includes a first portion attachable to a boat transom and a second portion adapted to support the marine propulsion device, moving means for moving the second portion relative to the first portion to move, by raising and lowering, the marine propulsion device relative to the boat transom, water sensor means for sensing an undesirable seawater level relative to the marine propulsion device and for generating a signal indicative of the undesirable water level, and actuating means responsive to the undesirable water level signal for actuating said moving means to move the marine propulsion device to a raised position.

In one form, the motor mounting means includes a first bracket attachable to the boat transom having upper and lower ends, and a second bracket spaced aft of the first bracket and adapted to support the marine propulsion device having upper and lower ends, an upper link pivotably connected at its ends to the upper ends of the first and second brackets, and a lower link pivotally connected at its ends to the lower ends of the first and second brackets. The brackets and links may form a parallelogram linkage which raises and lowers an outboard motor along a substantially vertical plane. In another form, the lower link is shorter in length than the upper link, and the second bracket is shorter in length than the first bracket so that a quadrilateral structure is provided whereby an outboard motor is simultaneously raised or lowered and rotated during movement thereof.

The moving means may comprise cylinder means operatively connected between the brackets and links of the motor mounting means for effecting movement of an outboard motor through pivotal movement of the brackets and links. In one form, the cylinder means has its cylinder end connected to the pivotable connection between one of the links and one of the brackets, and its rod end connected to the pivotable connection between the other of the links and the other of the brackets.

The water sensor means may be mounted at any desired location on the motor mounting means. Preferably, the water sensor means is a float switch mounted on the second bracket which supports the outboard motor. Additionally, the motor mounting means may include speed sensor means for sensing engine speed of the outboard motor and for generating a signal indicative of engine speed, and limit means responsive to the engine speed signal for preventing actuation of said actuating means when the engine speed is above a predetermined speed.

The present invention thus provides a motor mounting assembly for an outboard motor which advantageously orientates the motor with respect to the surface of the water. In particular, the present motor mounting assembly aids in keeping the engine dry through its ability to raise the engine as, for example, in following-wave conditions after a boat slows down too fast when coming off plane from a cruising position, or when launching a boat at a boat ramp before the boat floats off its trailer.

Another feature of the present motor mounting assembly is its ability to prevent raising of the outboard when the engine speed is above a predetermined speed.

This feature insures that the outboard motor will not be trimmed up or raised when a boat is on plane.

Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 2:
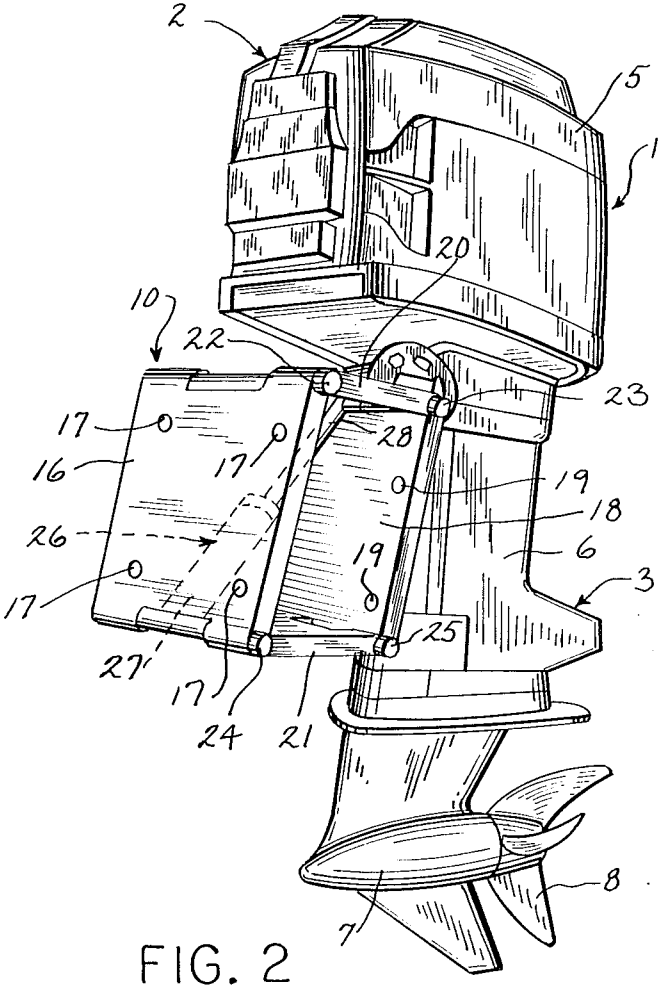
FIG. 2 is a perspective rear view of the motor mounting assembly with the transom removed for clarity.
Figure 1:
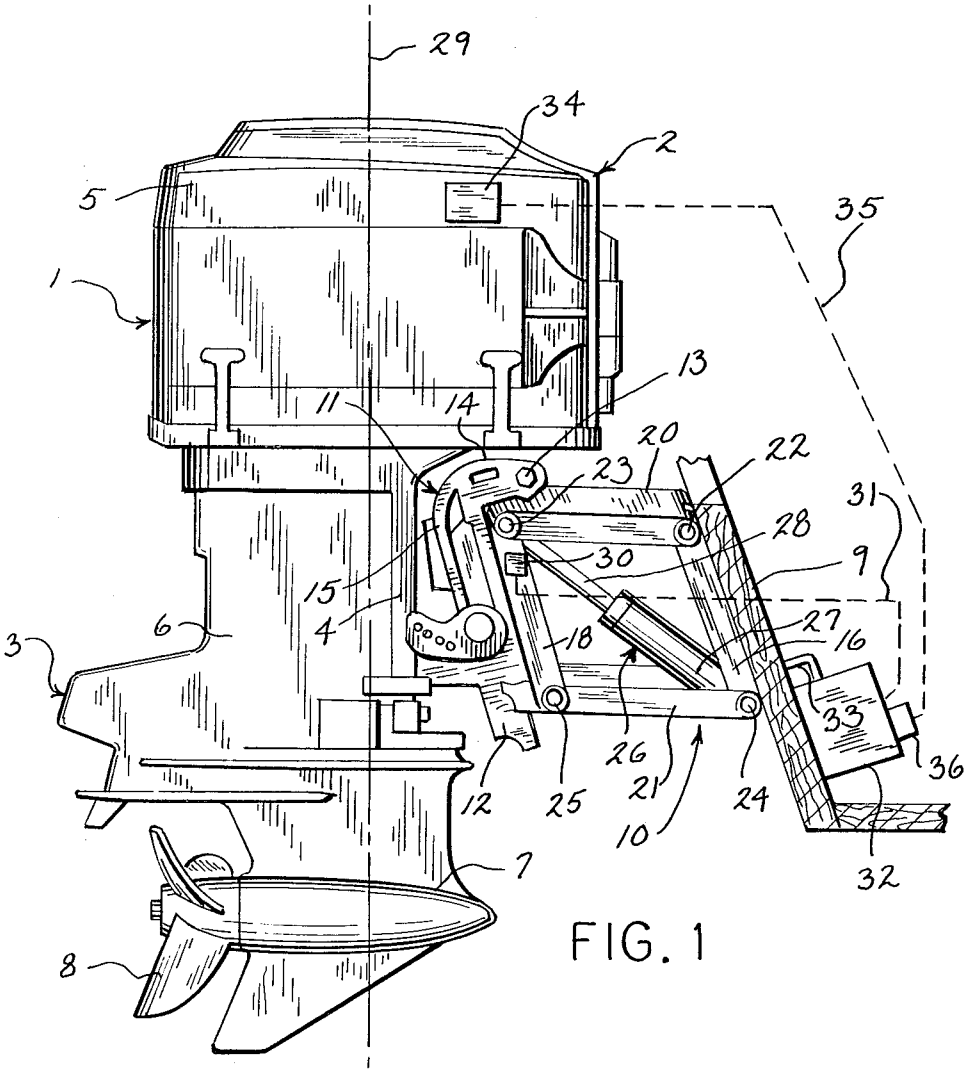
FIG. 1 is a perspective side view of an outboard motor mounting assembly in accordance with the present invention.

Referring now to the drawings, FIGS. 1 and 2 illustrate a marine propulsion drive in the form of an outboard motor 1 having a propulsion assembly including an upper unit or powerhead 2, a lower unit 3 and swivel bracket 4. Upper unit 2 includes a cover or cowl 5 defining an engine compartment for housing an internal combustion engine (not shown).

Lower unit 3 is rigidly mounted to the bottom of the powerhead or upper unit 2 and includes drive shaft housing 6 and a gear case 7. Gear case 7 is normally submerged in water during operation of outboard motor 1 and supports a rotatable propeller shaft carrying a propeller 8. Gear case 7 houses a suitable reversing transmission which drivingly connects propeller 8 to a drive shaft extending through the drive shaft housing 6 which drivingly interconnects the engine with propeller 8.

Lower unit 3 is connected to swivel bracket 4 for swivel or turning movement about a vertical axis and in a horizontal plane to provide steering control for outboard motor 1, as is conventional.

Outboard motor 1 is supported from a transom 9 of a boat by a mounting assembly 10, hereinafter to be described, and a transom bracket 11 on which swivel bracket 4 is mounted. Outboard motor 1 including swivel bracket 4 is connected to transom bracket 11 for pivotal or tilting movement about a horizontal transverse axis and in a vertical plane, which extends parallel to the longitudinal dimension of a boat, between an operating position wherein gear case 7 and propeller 8 are fully submerged in water, and a tilted or nonoperating position wherein gear case 7 and propeller 8 are raised from the water, as for trailering.

Transom bracket 11 includes two spaced apart clamp members or mounting members 12 (only one of which is shown in FIG. 1) for removably mounting outboard motor 1 to mounting assemby 10. Clamp members 12 of transom bracket 11 are connected by a pivot pin or tilt shaft 13 which extends substantially horizontally between the upper ends of clamp members 12. Each clamp member 12 has an upper body portion 14 with an integral outside leg 15 extending downwardly therefrom which includes a plurality of vertically spaced bolt-receiving openings (not shown) therein. Transom bracket 11 and thus outboard motor 1 may be removably mounted and secured to mounting assembly 10 by means of through bolts (not shown) in the conventional manner.

Mounting assembly 10 is in the form of a parallelogram linkage, and comprises a first or transom mounting bracket 16 adapted to be attached to the boat transom 9 by means of bolts (not shown) passing through four openings 17 (see FIG. 2) into transom 9, a second or motor supporting bracket 18 adapted to support the outboard motor 1 by means of bolts (not shown) passing through openings 19 (see FIG. 2) into transom bracket 11, an upper link 20 extending between the upper ends of brackets 16 and 18, and a lower link 21 extending between the lower ends of brackets 16 and 18. Links 20 and 21 each include a fore end closest to transom 9 and an aft end spaced from transom 9 and closest to motor 1. Fore end of upper link 20 is pivotally connected at 22 to the upper end of transom mounting bracket 16, and the aft end of upper link 20 is pivotally connected at 23 to the upper end of motor supporting bracket 18. Likewise, the fore end of lower link 21 is pivotally connected at 24 to the lower end of transom mounting bracket 16, and the aft end of lower link 21 is pivotally connected at 25 to the lower end of motor supporting bracket 18. As shown best in FIG. 2, brackets 16, 18 and links 20, 21 are in the form of steel plates which provide dimensional rigidity for mounting assembly 10. The pivotal connections 22–25 are provided by respective bolts or pins which extend through the pivotally connected components.

In an alternate embodiment (not shown), mounting assembly 10 is in the form of a quadrilateral linkage wherein bracket 18 is shorter in length than bracket 16, and link 21 is shorter in length than link 20 to provide the quadrilateral linkage arrangement. Typically, bracket 18 might be 16 inches in length while bracket 16 might be 18 inches in length, and link 21 might be 23.75 inches long while link 20 might be 24 inches long.

Means is also provided for selectively moving motor supporting bracket 18 relative to transom mounting bracket 16 and transom 9 between a first position locating motor supporting bracket 18 in a lower position and second position locating the motor supporting bracket 18 in a raised position. In order to accomplish this, a hydraulic cylinder 26 extends between the pivotal connections 23 and 24. As shown in the drawings, hydraulic cylinder 26 has its cylinder end 27 connected to pivotal connection 24, and its rod end 28 connected to pivotal connection 23. Thus, upon extension of cylinder 26 bracket 18 and motor 1 may be moved to an elevated or raised position while upon retraction of cylinder 26 bracket 18 and motor 1 are moved to a lowered position.

Due to the configuration of mounting assembly 10 as a parallelogram, extension and retraction of hydraulic cylinder 26 moves longitudinal axis 29 of motor 1 in a vertical plane which extends parallel to the longitudinal dimension of a boat. As shown best in FIG. 1, axis 29 is defined as being parallel to the axis of the driveshaft contained within driveshaft housing 6.

As shown best in FIG. 1, mounting assembly 10 includes water sensor means 30 in the form of a float switch mounted on the side of motor supporting bracket 18 adjacent pivotable connection 23. The contacts within sensor 30 are normally open, but are closed when the seawater level causes a float element (not shown) therein to rise upon contact with the water. Sensor 30 is connected via an electrical line schematically shown at 31 to a hydraulic pump 32 so that when the contacts therein are closed a signal is received by pump 32 causing pump 32 to be actuated to extend cylinder 26 and lift outboard motor 1 to a raised position. Pump 32 is connected to the inlet and outlet of cylinder 26 via hydraulic line 33.

Additionally, mounting assembly 10 includes a speed sensor 34 for sensing engine speed of outboard motor 1. Speed sensor 34 may be of any conventional type such as a tachometer that generates a signal indicative of engine speed, for example revolutions per minute, and is connected via an electrical line schematically shown at 35 to a limit switch 36 mounted on pump 32. Limit switch 36 receives the signal generated by sensor 34 and prevents actuation of pump 32 to extend cylinder 26 and raise outboard motor 1 when the engine speed is above a predetermined speed or limit. For example, this upper limit might be approximately 2000 revolutions per minute. Limit switch 36 thus insures that cylinder 26 will not be extended to raise outboard motor 1 when the boat is on plane during a cruising operation.

In operation, motor mounting assembly 10 aids in keeping the engine within powerhead 2 dry through its ability to raise motor 1 upon the undesirable rise of water level with respect to powerhead 2. For example, this might occur in following wave conditions after a boat slows down too fast when coming off plane from a cruising position, or when launching a boat at a boat ramp before the boat floats off its trailer. Under these and similar conditions, the float element of water sensor 30 will raise off its seat to close the contacts therein causing actuation of pump 32 to extend cylinder 26 and lift outboard motor 1 to a raised position. Thus, powerhead 2 is protected from submersion in water. Additionally, speed sensor 34 insures that outboard motor 1 will not be raised when the boat is on plane since limit switch 36 prevents actuation of pump 32 when the engine speed of motor 1 is above a predetermined speed or revolutions per minute.

A mounting assembly for an outboard motor has been illustrated and described. Various modifications and/or substitutions of the specific components described and illustrated herein may be made without departing from the scope of the present invention. For example, brackets 16, 18 and links 20, 21 may be composed of a frame work of bars as opposed to the rigid plates described and illustrated herein. Additionally, any one of brackets 16, 18 and/or links 20, 21 may be a hydraulic cylinder which may be controlled to accomplish the movements described and illustrated herein. Further, the engine speed limit set by limit switch 36 and location of water sensor 30 are variable and are established according to the particular engine and operating environment.

Various modes of carrying out the invention are contemplated as being within the scope of the following claims particularly pointing out and distinctly claiming the subject matter which is regarded as the invention.

I claim:

1. A mounting assembly for a marine propulsion device comprising:

motor mounting means for supporting a marine propulsion device wholly aft of a boat transom, said motor mounting means including a first portion attachable to a boat transom and a second portion adapted to support the marine propulsion device;

moving means for moving said second portion relative to said first portion to move the marine propulsion device between raised and lowered positions relative to the boat transom;

water sensor means for sensing an undesirable seawater level relative to the marine propulsion device and for generating a signal indicative of said undesirable water level; and actuating means responsive to said undesirable water level signal for actuating said moving means to move the marine propulsion device to a raised position.

2. The mounting assembly of claim 1 wherein said water sensor means is mounted on said motor mounting means.

3. The mounting assembly of claim 1 wherein said water sensor means comprises a float switch.

4. The mounting assembly of claim 1 further including speed sensor means for sensing engine speed of said marine propulsion device and for generating a signal indicative of engine speed, and limit means responsive to said engine speed signal for preventing actuation of said actuating means when said engine speed is above a predetermined speed.

5. The mounting assembly of claim 1 wherein said motor mounting means includes:

a first bracket attachable to the boat transom, said first bracket having upper and lower ends;

a second bracket spaced aft of said first bracket and adapted to support the marine propulsion device, said second bracket having upper and lower ends;

an upper link pivotally connected at its ends to said upper ends of said first and second brackets; and a lower link pivotally connected at its ends to said lower ends of said first and second brackets.

6. The mounting assembly of claim 5 wherein said moving means includes cylinder means operatively connected between said brackets and links for effecting movement of said marine propulsion device through pivotal movement of said bracket and links.

7. The mounting assembly of claim 6 wherein said cylinder means has its cylinder end connected to the pivotal connection between one of said links and one of said brackets and its rod end connected to the pivotal connection between the other of said links and the other of said brackets.

* * * * *